US007563001B2

(12) United States Patent
Bobbin et al.

(10) Patent No.: US 7,563,001 B2
(45) Date of Patent: Jul. 21, 2009

(54) MODULE ADAPTER FOR PORTABLE LIGHT SOURCES

(75) Inventors: Joseph Bobbin, Nanticoke, PA (US); John Devaney, Mountain Top, PA (US); Mark Dirsa, Shavertown, PA (US)

(73) Assignee: Koehler-Bright Star, Inc., Hanover Township, PA (US)

( * ) Notice: Subject to any disclaimer, the term of this patent is extended or adjusted under 35 U.S.C. 154(b) by 0 days.

(21) Appl. No.: 11/807,465

(22) Filed: May 29, 2007

(65) Prior Publication Data

US 2008/0030977 A1 Feb. 7, 2008

Related U.S. Application Data

(63) Continuation-in-part of application No. 11/535,428, filed on Sep. 26, 2006.

(60) Provisional application No. 60/821,034, filed on Aug. 1, 2006.

(51) Int. Cl.
*F21V 33/00* (2006.01)

(52) U.S. Cl. ..... 362/253; 362/190; 362/191; 362/200; 362/208

(58) Field of Classification Search ..... None
See application file for complete search history.

(56) References Cited

U.S. PATENT DOCUMENTS 5,592,066 A * 1/1997 Fan ..... 320/113
5,655,308 A * 8/1997 McDermott ..... 33/361
6,296,370 B1 * 10/2001 Bamber et al. ..... 362/190
6,623,140 B2 * 9/2003 Watterson et al. ..... 362/184
6,945,666 B2 * 9/2005 Woolfson ..... 362/183
7,063,438 B2 * 6/2006 Sze-Tai ..... 362/199

OTHER PUBLICATIONS

Admitted Prior Art—5 sheets of photographs illustrating "BeltPED Receiver" first sold in U.S. by Mine Site Technologies (USA) Inc. approx. 10 years ago.

* cited by examiner

*Primary Examiner*—Laura Tso
(74) *Attorney, Agent, or Firm*—DLA Piper LLP (US); R. Blake Johnston

(57) ABSTRACT

An adapter for a portable light source permits a module to be attached to the portable light source and powered by the power source of the portable light source. In one embodiment of the invention, the power source is a battery and the adapter includes a bottom plate and a housing defining a compartment that holds the module. In this embodiment, the bottom plate of the adapter features a positive contact opening and a negative contact opening adapted to receive and electrically communicate with the positive and negative terminals of the battery. The bottom plate of the adapter also includes positive and negative contact leads which communicate with the contact openings and the module so that the latter receives power from the battery.

16 Claims, 11 Drawing Sheets

MODULE ADAPTER FOR PORTABLE LIGHT SOURCES

CROSS-REFERENCE TO RELATED APPLICATIONS

This application is a continuation-in-part of U.S. patent application Ser. No. 11/535,428, filed Sep. 26, 2006, which claims the benefit of U.S. Provisional Application No. 60/821,034, filed Aug. 1, 2006.

FIELD OF INVENTION

The present invention relates to flashlights, lanterns, cap lamps and other portable light sources and more specifically to an adapter that provides power to a module from the power source of the portable light source.

BACKGROUND

The use of a portable light source to power an additional electric device or module via a power takeoff from the power source of the portable light source is known for a number of applications.

Once example is the use of secondary lighting sources on a battery-powered flashlight or lantern. The secondary lighting source may provide an alternative type of light for the user or may provide a flashing, high-visibility light so that the user may be seen and/or located. One can certainly replace one light bulb for another in incandescent versions of such powered flashlights or lanterns. However, if the secondary light source requires replacement of its functional components, apart from a bulb, often times the flashlight or lantern is not configured for ready replacement or repair of the secondary light source.

Another example is in mining cap lamps. Such lamps are typically mounted on hard hats worm by miners to provide illumination in underground mine shafts. Such cap lamps are well known in the mining equipment industry and provide illumination while the miner's hands remain free to perform tasks. A cap lamp typically receives power from a battery power pack secured to the user's waist. Electrical wiring delivers power from the power pack to the lamp on the helmet. Normally, at the end of each working shift, the helmet and power pack are removed by the miner and the power pack is placed in a recharging device so that it is ready for use during a future shift.

Modern day mines often include a miner tracking system so that the location of miners may be tracked for safety purposes. Such systems often include sensors positioned throughout the mine shafts. A miner wears a radio frequency identification (RFID) tag which broadcasts a signal including the identity of the miner wearing the RFID tag. When the miner passes a miner tracking system sensor, the sensor receives the signal from the RFID tag. The sensors communicate with a central computer which tracks the location of miners wearing the RFID tags based on which sensors have received signals from the miners' RFID tags.

The RFID tags must receive electrical power to operate. Traditionally, wires have been soldered to the battery terminals of the cap lamp power pack and to the RFID tags so that the RFID tags receive power from the battery of the cap lamp power pack. A problem with such an arrangement, however, is that such modifications are time consuming and inconvenient. In addition, and more importantly, the quality of the soldered connections is often inconsistent which leads to reliability issues, especially in the harsh mining environment.

The exposed wires of such a power takeoff are also exposed which makes them even more susceptible to damage.

DETAILED DESCRIPTION OF PREFERRED EMBODIMENTS

Figure 1:
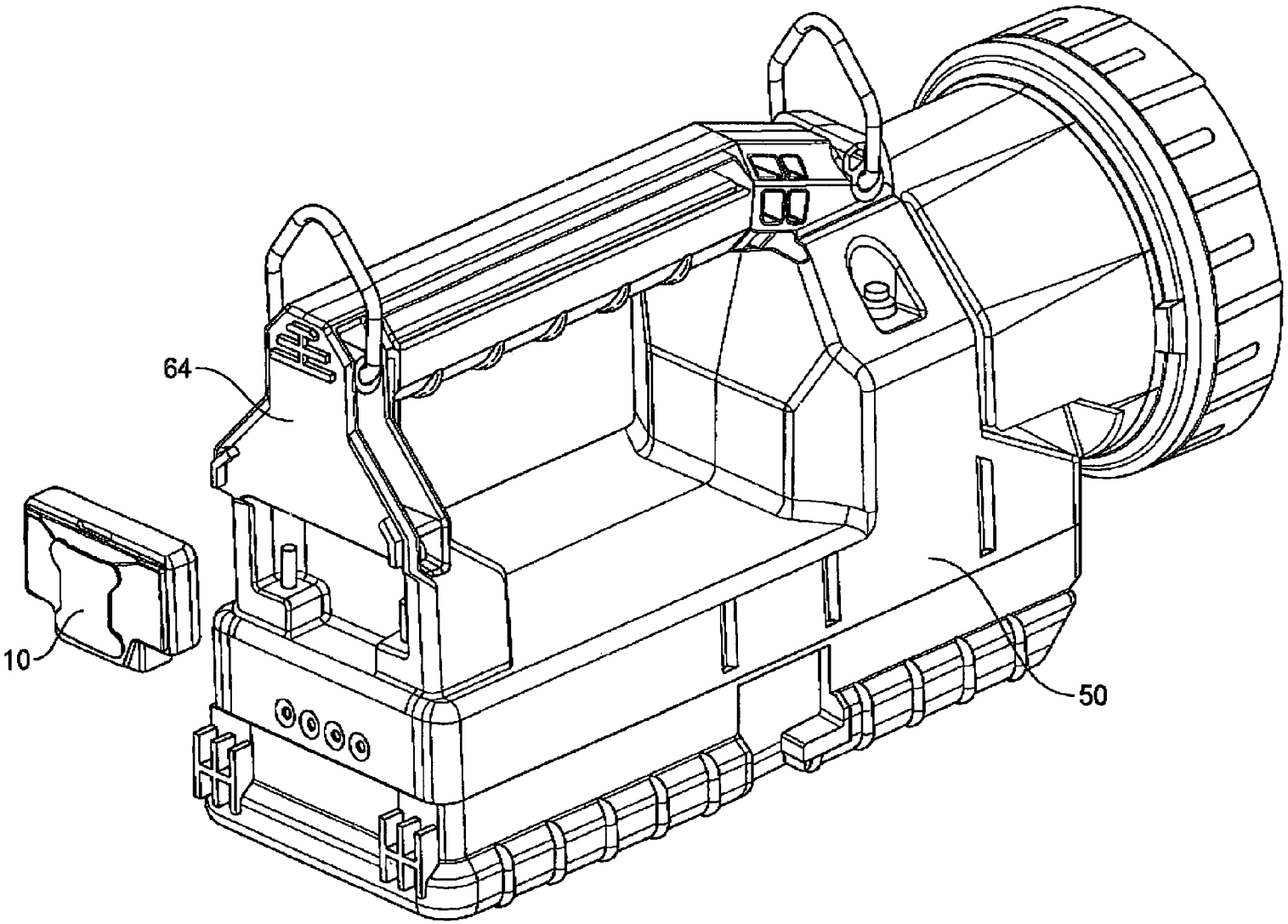
FIG. 1 is a perspective view of a module detached from a flashlight body, in accordance with a first embodiment of the invention.
Figure 2:
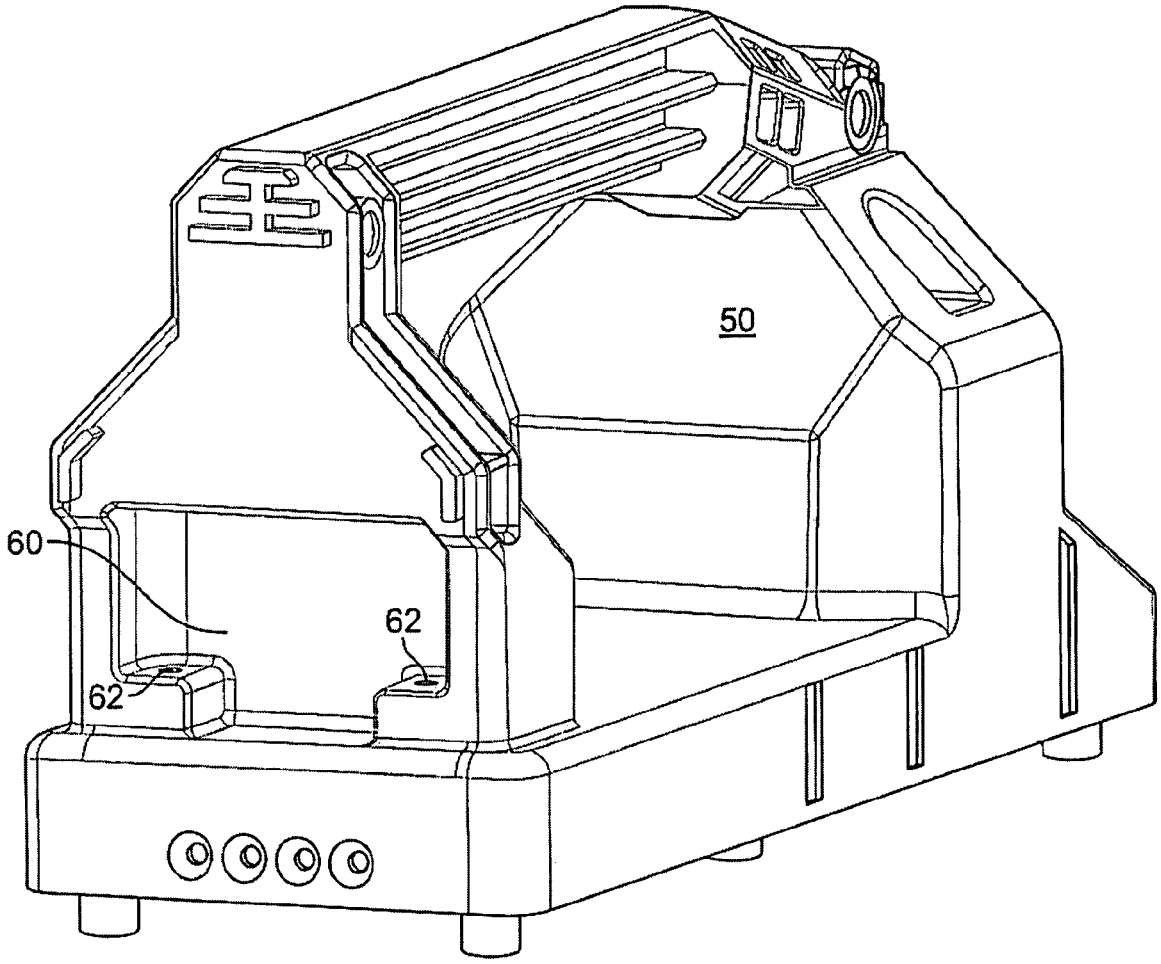
FIG. 2 is a perspective view of flashlight body with a pocket for receiving a module, in accordance with the first embodiment of the invention.
Figure 3:
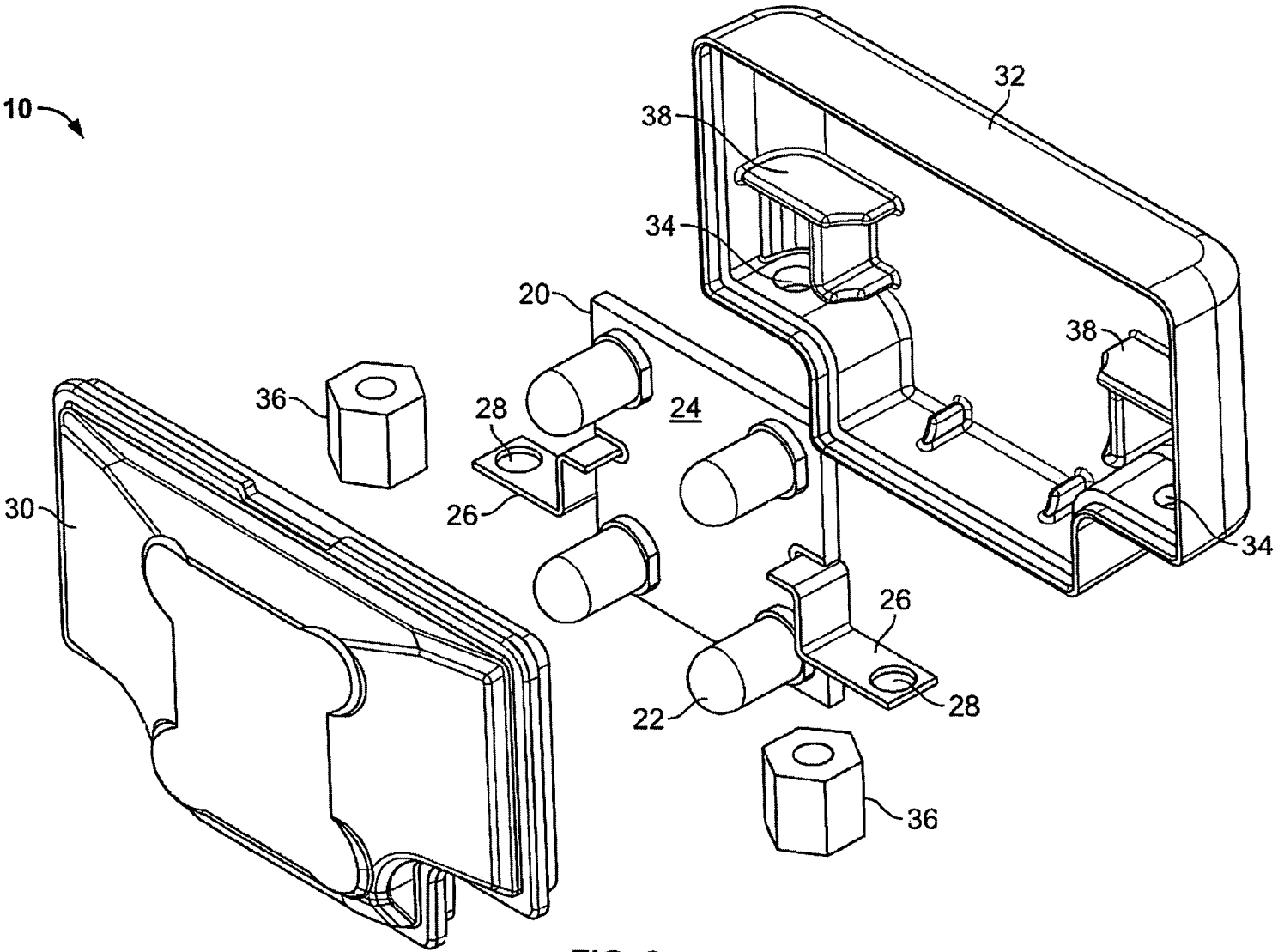
FIG. 3 is an exploded view of a module, in accordance with the first embodiment of the invention.
Figure 4:
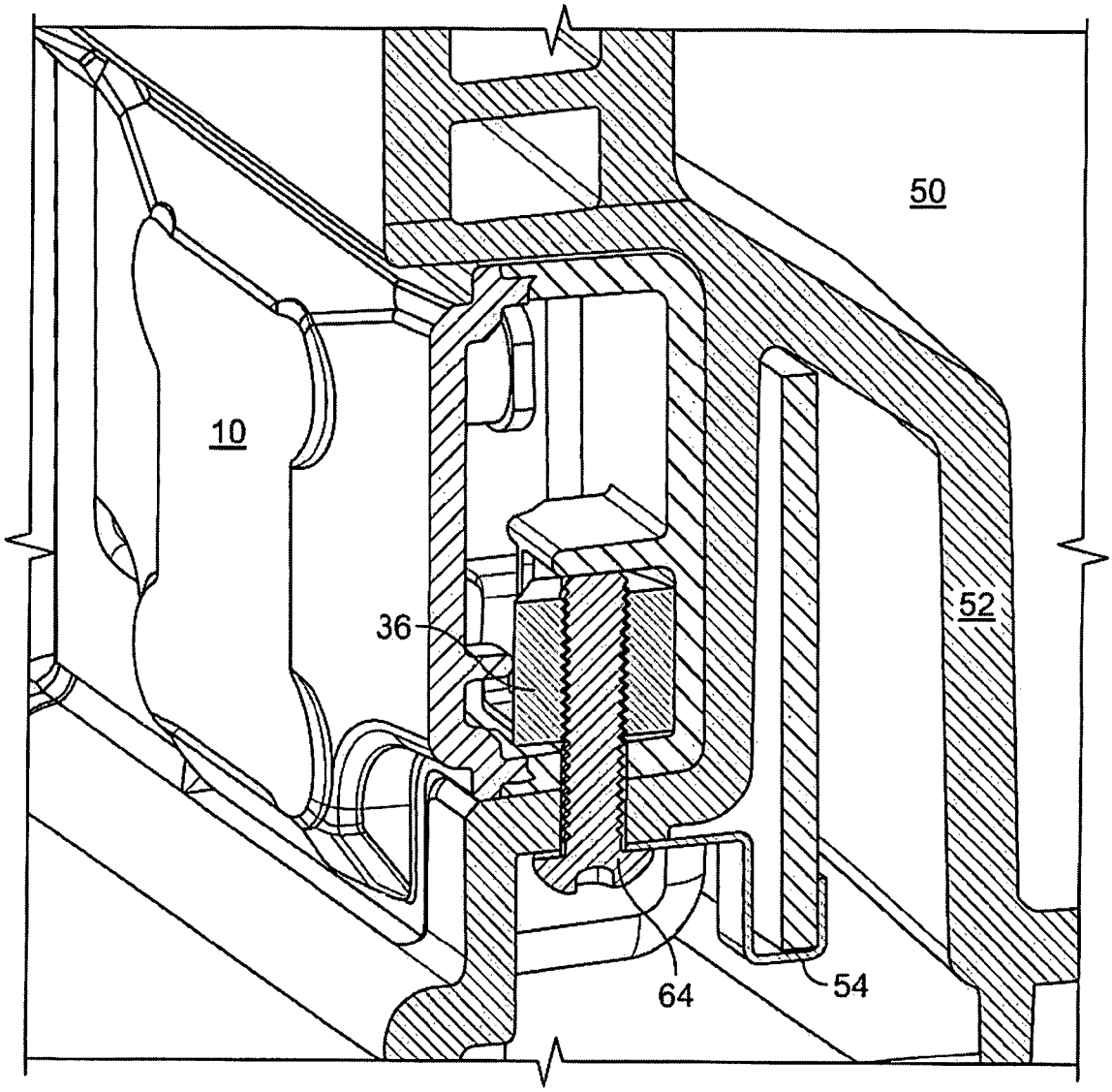
FIG. 4 is a cut-away view of a module within a pocket of a flashlight, in accordance with the first embodiment of the invention.
Figure 5:
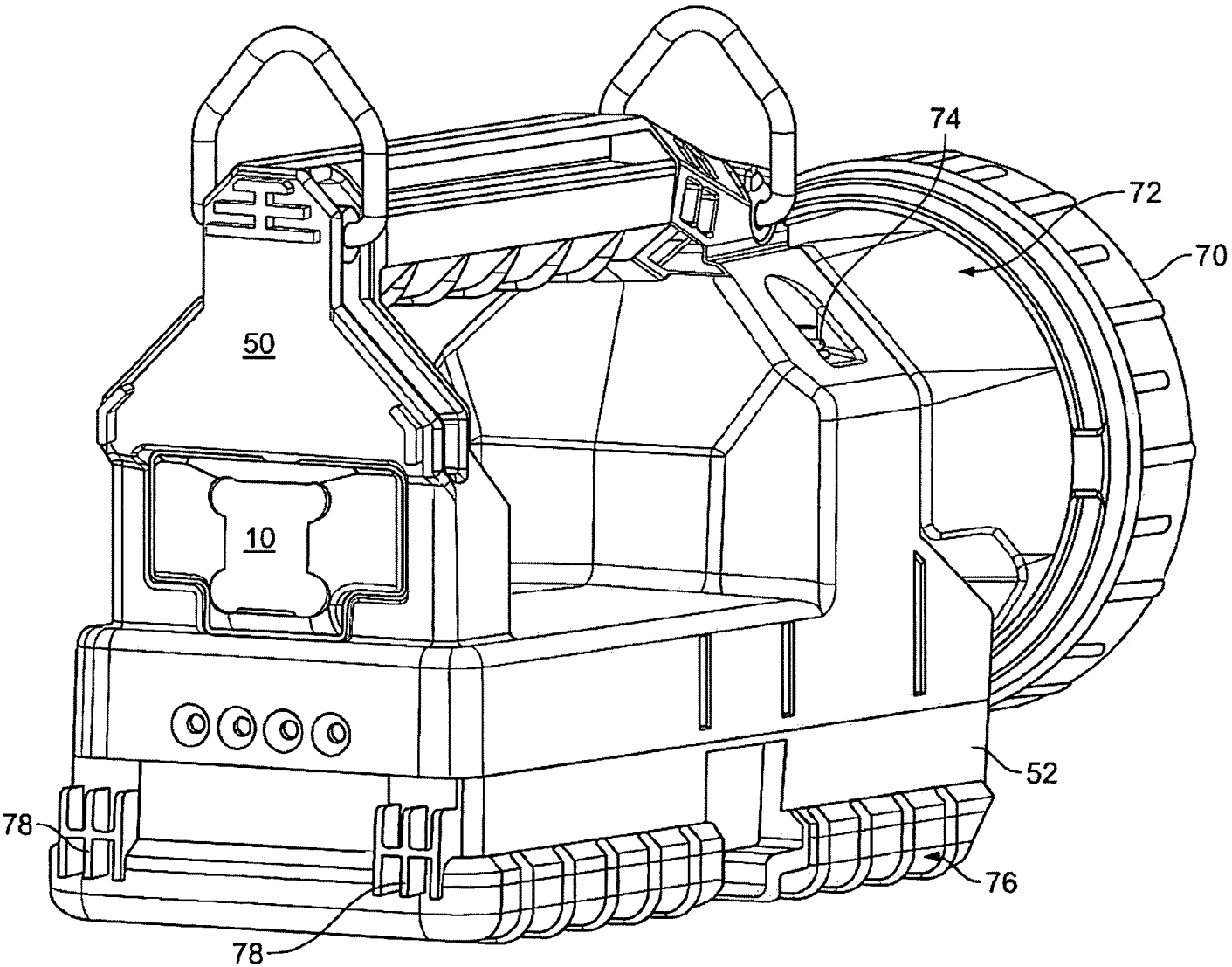
FIG. 5 is a perspective view of a module and a flashlight, in accordance with the first embodiment of the invention.

A first embodiment of the present invention includes a flashlight 50 having a body 52, as shown in FIGS. 1, 2, and 5. The flashlight, however, is not limited to the flashlight as shown in FIGS. 1, 2, and 5, but instead can have any particular body shape, size, configuration, or assembly. In addition, while FIGS. 1-5 illustrate a flashlight, the invention may be applied to other portable light sources including lanterns, spotlights, mining cap lamps and other portable light sources known in the art.

A power source is located within the body of the flashlight. The power source may be any suitable power source or device known in the art, such as a battery. A particularly preferred power source is a lithium-ion battery. Alternatively, the power source may be contiguous to the body of the flashlight, but need not be located within the body; for example and without limitation, the power source could be located contiguous to the outer surface of the body.

As will be explained in greater detail below, an electrical device or module also receives power from the power source of the flashlight of FIGS. 1-5. In the first embodiment of FIGS. 1-5, the module is an LED lighting module 10, as shown in FIGS. 3 and 4. The module of the present invention, however, is not limited to a particular shape, size, configuration, or assembly. Nor is a module of the present invention limited to a lighting module. The module may perform any function, and is preferably selected from the group consisting of a lighting module, a GPS navigation module, a tracking module, a natural gas detection module, and a radio module.

The module may be contiguous to any region on the outer surface of the body of the flashlight. For example, as illustrated in the first embodiment of FIGS. 1-5, the module may be contiguous to a rear end of the flashlight.

Preferably, the module will be attached or connected to any region on the outer surface of the body of the flashlight. The attachment or connection may be permanent or semi-permanent. The module is preferably removeably attached or connected (with or without any degree of destruction of the module or any parts or surfaces to which it is attached or connected, but preferably without any such degree of destruction). Any known connection or attachment elements or techniques known in the art may be utilized. Preferably, when the flashlight contains a power source (whether contiguous to or within the body of the flashlight) for powering the module, connection or attachment elements or techniques are employed, such that the module receives power from the power source through the connection or attachment elements or the connection or attachment structure resulting from the particular technique that was employed.

In an alternative embodiment, a flashlight may include more than one module. A flashlight may include, for example and without limitation, a first module that is contiguous to the rear end of the flashlight and a second module that is contiguous to a side of the flashlight. Alternatively, a flashlight may include, as another non-limiting example, at least one module that is contiguous to one side of the flashlight and at least one additional module that is contiguous to another side of the flashlight. As another example, a flashlight may include at least one module that is contiguous to the rear end of the flashlight and at least one additional module that is contiguous to the front end of the flashlight (and optionally at least one further module that is contiguous to at least one side of the flashlight).

In the first embodiment of FIGS. 1-5, the primary lamp is a main lamp assembly 72, as shown in FIG. 5. The outer surface of the body of the flashlight defines a pocket or recess, and the module is contiguous to said pocket or recess. More specifically, as shown in FIGS. 2 and 4, the outer surface defines a pocket or recess 60, which is configured to receive in a substantially complementary manner a lighting module 10, such that the module is contiguous (preferably attached or connected, even more preferably removably attached or connected) to the pocket or recess. The module 10 is also generally shown in FIGS. 1 and 5 in connection with the flashlight 50. As used herein, "pocket" or "recess" does not encompass a hole or opening in the outer surface of the body of the flashlight. However, alternatively, the outer surface of the body of the flashlight may comprise a hole or opening which is configured to receive the module in a substantially complementary manner, such that the module is contiguous (preferably attached or connected) to the hole or opening.

The module 10 is shown in more detail in an exploded view in FIG. 3. The module, 10 is comprised of a light source 20, inserted between front 30 and back 32 covers. As is well understood in the art, at least a portion of front cover 30 should be transparent or translucent to light. Light source 20 is comprised of at least one light emitting diode (LED) 22 connected to a circuit board 24. Other light sources known in the art, such as incandescent lights, may be used in place of the LEDs 22 and/or the circuit board 24. Light source 20 has positive and negative electrical contacts 26 connected thereto. The light source 20 is then placed on either of covers 30 or 32. In this embodiment of the invention, the electrical contacts 26 comprise apertures 28 that are matched to mounting apertures 34 in the back cover 32. While mounting apertures 34 are shown here located on the bottom of the cover, other positions, such as in the front cover, may be used. Retention nuts 36 or similar connection or attachment elements are lined up with the apertures 28 of the electrical contacts 26 and the mounting apertures 34 in this embodiment.

To assist the process of retaining the light source 20 and retention nuts 36, the back cover 32 is shown in FIG. 3 with retention clips 38 into which the light source 30 and retention nuts 36 are frictionally retained. The module 10 assembly is completed by sealing the front cover 30 to the back cover 32, with the light source 20 retained therein. In one embodiment of the invention, the covers 30, 32 are constructed of polycarbonate or other thermoplastic resin and ultrasonically welded together. Other materials and sealing or attachment techniques known in the art may be utilized. As one such example, the back cover can be constructed of nylon and the two covers attached together by screws. Further, it has been found that the use of a lip on one of the covers facilitates mating of the two covers together.

Referring to FIG. 2, a pocket or recess 60 has a plurality of apertures 62 that correspond in position to mounting apertures 34. In one embodiment of the invention, as shown in FIG. 4, the module 10 is secured to the main body portion 52 of the flashlight 50 by fastening screws 64 or similar fasteners that are placed from within the main body portion 52, through the underside of apertures 62, mounting apertures 34, contacts 26 and retaining means 36. Fastening screws 64, also shown in FIG. 1, are electrically conductive. As can be seen in FIG. 4, fastening screws 64 conduct electrical power and control from the main body 52 of the flashlight 50 (and constituent parts) to the module 10 through contact 54, which may be a wire, conductive plate, or other similar conductor known in the art. The flashlight 50 with the light source 10 mounted therein is shown in FIG. 5. In another embodiment of the invention, the fastening screws 64 or similar fasteners can be directly molded in situ with the body 52 of the flashlight.

In an alternative embodiment of the invention, the module 10 is attached or connected to the flashlight 50 without screws or similar semi-permanent fasteners, but rather metal snaps on either of covers 30, 32 comprising the module housing that mate with detents in the flashlight housing. The metal snaps could double as the electrical contacts to power and retain the module in the flashlight housing. Plastic snaps may also be used, with the provision of separate electrical contacts on the module. The configuration as shown in FIG. 2 can readily be converted to such a configuration by replacing the existing fastening screws 64 with pins molded into or otherwise fastened to the flashlight housing in the same location and orientation as the disclosed screws. The module is then modified in this embodiment to create u-shaped slot features to mate the aforementioned electrical contacts with the aforementioned electrical contact pins. A retractable lever or spring-loaded detent mechanism could be utilized to securely retain the module on the pins in the recessed pocket of the flashlight housing. With this readily detachable module arrangement, one can provide a power take-off cord that can be plugged into the recessed pocket of the flashlight body. This cord would mate mechanically and electrically with the contact pins providing a method to power auxiliary equipment such as a gas detector or remote/flexible work light or headlamp.

One advantage of the present invention is the ability to replace readily an installed module with another identical module, for example, in the event of damage. In one embodiment of the invention, when LEDs are the light source 22, they can be used to signal the user's location through continuous illumination or a blinking, flashing or other pattern. The ready replacement of modules allows one to replace easily one LED lighting module with another, different module that has different colored LEDs or non-flashing LEDs, or with another type of lighting module for purposes other than signaling one's location. For instance, an alternate lighting module may function as an area work light projecting light over a larger area but at close proximity to the flashlight, complementing the tightly focused main light beam of the main flashlight light. The instant invention is also adapted in further embodiments for accepting other non-lighting modules, such as radios, natural gas detectors, tracking systems, GPS navigation systems, and power take-offs, and generally, any type of module having a designated function. The power take-off module is particularly useful in combination with a battery/power protection circuit.

The flashlight optionally includes a rotatable main light source 70, where the main lamp assembly 72 is waterproof and connected to the body/battery 52 compartment by clamping the pivot-points on the main lamp housing between the upper and lower halves of the body/battery compartment, as shown in FIG. 5. When in the home position, the light 70 faces directly forward. The main lamp assembly 72 can be rotated towards the bottom of the light from the home position; in one embodiment up to 100 degrees. When a fixed main lamp assembly is desired, the flashlight can be configured with additional components that lock the main lamp assembly in the home position. In addition the main lamp assembly, pivot-points protrude through replaceable pivot sleeves with integral detents and replaceable wear plates that prevent the main lamp assembly from rotating freely, thus locating the head in a plurality of useful angles for simple hands free use. Further usefulness is gained from the balance of the complete assembly that allows it to be stood on its back end stabilized by several small protrusions on the rear facing walls of the flashlight.

The flashlight also optionally includes a recessed key-shaped features 78 on the body 52 of the flashlight, as shown in FIG. 5, to lock the flashlight into a charging/storage cradle. This is an advantage over similar lights in that this feature allows the bottom of the flashlight to be flat, aiding emergency personnel when using the light to crawl through hazardous areas (for example, firemen in particular often crawl through burning structures). Similar flashlights have external protrusions designed to lock into the recesses of a charging cradle. These protrusions are often subject to damage from dropping and can become snagged on debris encountered during emergency situations. The flat bottom of a flashlight of the present invention allows full contact with the non-slip rubber bumper 76, above, providing greater stability when crawling or balancing the flashlight on uneven surfaces during hands-free operation.

In addition, the flashlight optionally includes a low battery indicator that uses a microprocessor to interpret battery voltage, temperature effects and load effects on 4, 6 or 8-cell li-ion battery packs, for example. Low voltage is signaled through use of a low power LED 74, as shown in FIG. 5. This LED 74 will activate when approximately 30 minutes of runtime is remaining for the main lamp. This indicator provides additional convenience/safety for emergency personnel to evacuate from remote or hazardous locations.

In a second embodiment of the invention, an adapter attaches a module to a portable light source so that it may receive power from the power source of the portable light source. While this second embodiment of the invention is described below in terms of a battery power pack for a mining cap lamp, it is to be understood that the invention may be used with any portable light source.

Figure 6:
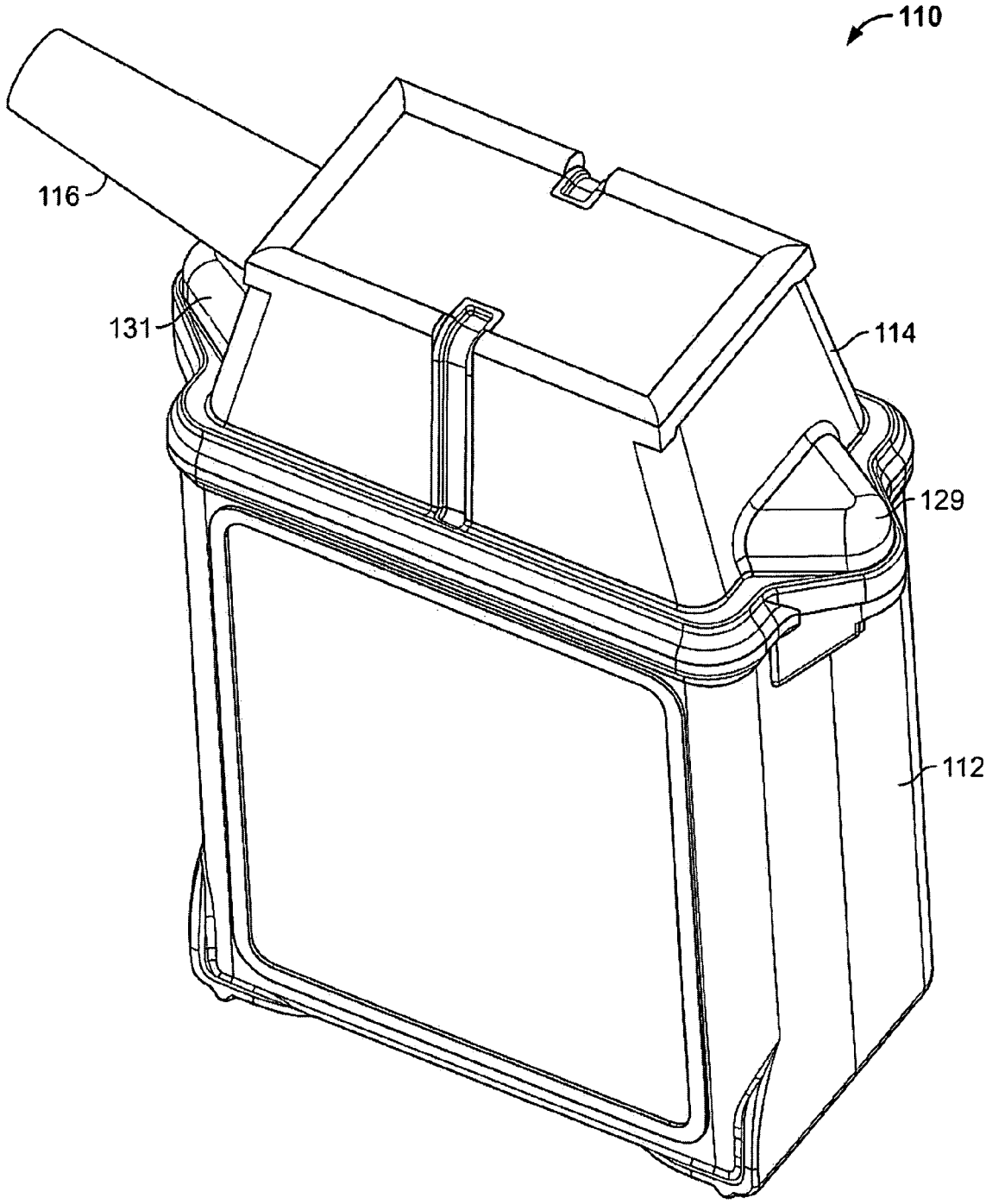
FIG. 6 is perspective view of a battery power pack for a cap lamp suitable for use with a second embodiment of the present invention.

A battery power pack for a mining cap lamp is indicated in general at 110 in FIG. 6. While the battery power pack may contain any kind of battery, a lithium-ion battery is preferred. An example of such a battery power pack may be found in the WHEAT LI-16 Electric Cap Lamp System from Koehler-Bright Star, Inc. of Hanover Township, Pa.

As illustrated in FIG. 6, the battery power pack 110 includes a body 112 and a removable top cover 114. As is illustrated in U.S. Pat. No. 4,481,458 to Lane, the contents of which are hereby incorporated by reference, the top cover receives an electrical power cord via cord strain relief 116 so that a mining cap lamp, which serves as the primary lamp of the system, receives power from the battery positioned within the power pack body 112.

Figure 7:
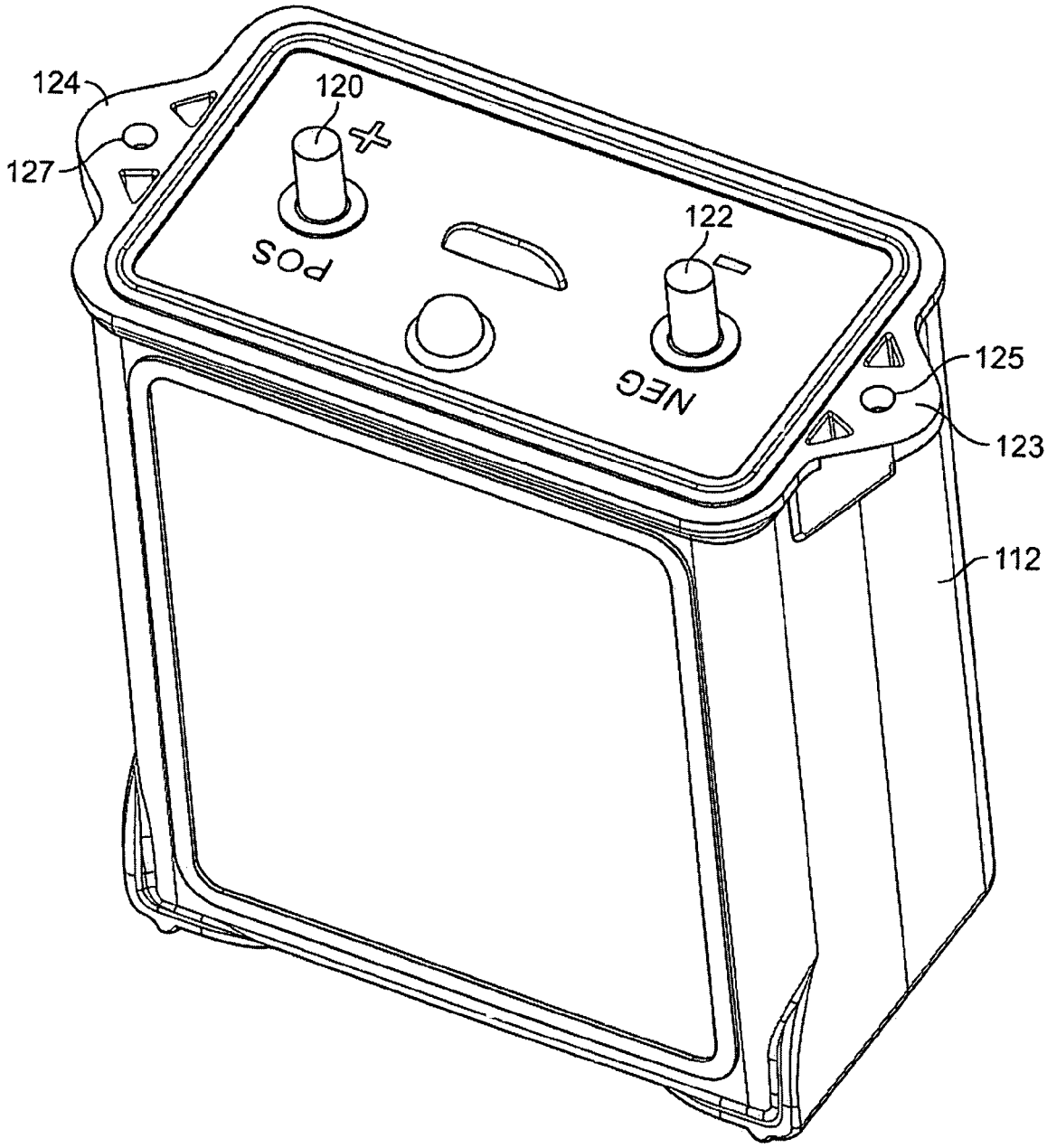
FIG. 7 is a perspective view of the battery power pack of FIG. 6 with the top cover removed.

As illustrated in FIG. 7, when the top cover 114 of FIG. 6 is removed, the positive terminal 120 and negative terminal 122 of the power pack are exposed. The electrical power cord exiting the top cover of the power pack, described in the preceding paragraph, communicates with these terminals to provide power to the mining cap lamp. The body 112 of the power pack is provided with a pair of flanges 123 and 124 featuring apertures 125 and 127. The apertures receive a pair of screws (not shown) which engage flanges 129 and 131 of the top cover 114 (FIG. 6) to secure the top cover to the body 112.

Figure 8:
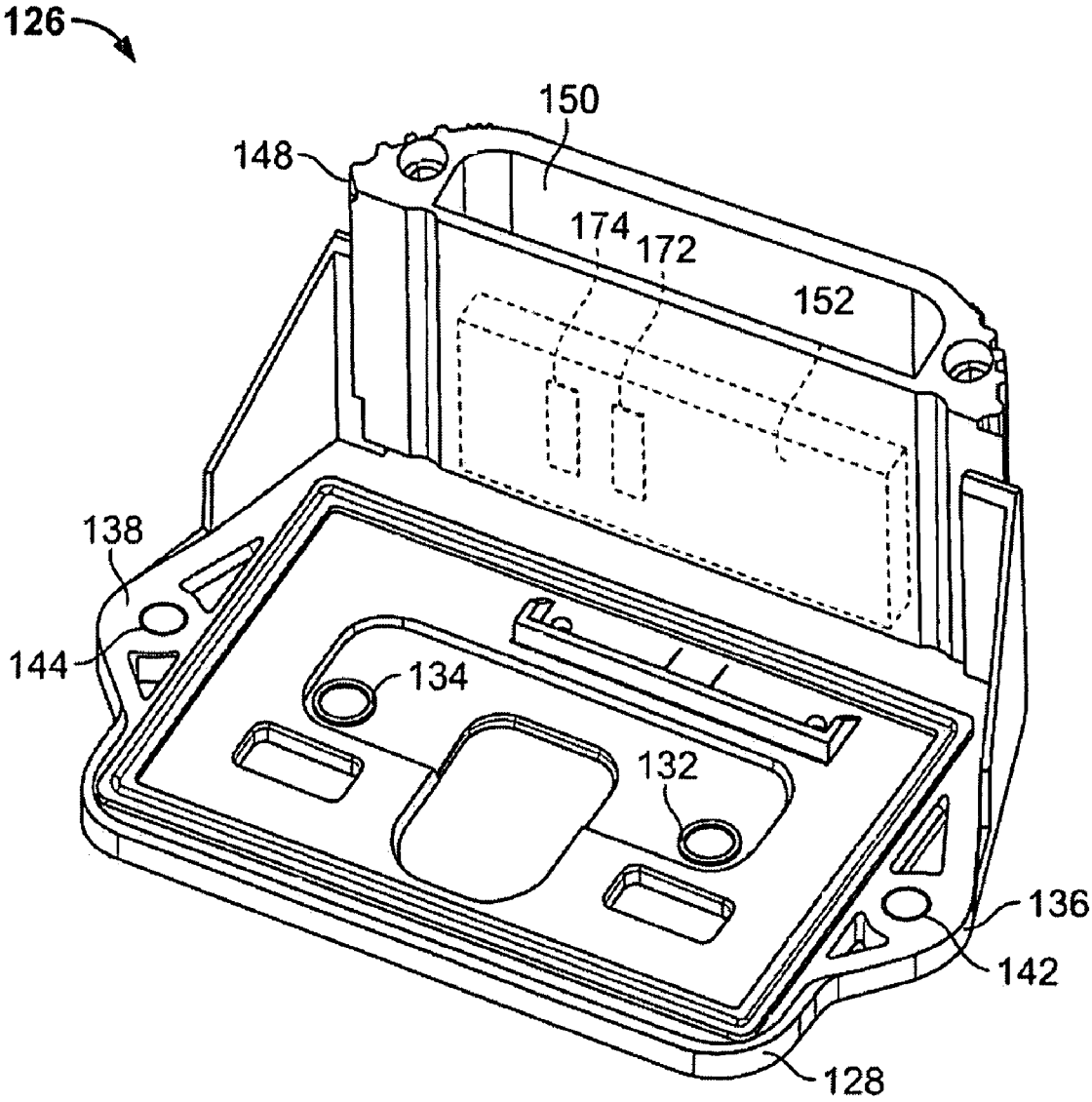
FIG. 8 is a perspective view of an embodiment of an adapter in a second embodiment of the invention.

An adapter constructed in accordance with the present invention is indicated in general at 126 in FIG. 8. As will be described in greater detail below, the adapter 126 is configured to quickly and easily connect to the battery power pack of FIGS. 6 and 7. As illustrated in FIG. 8, the adapter includes a bottom plate 128 that includes a pair of spaced contact openings 132 and 134. In addition, the bottom plate 128 includes a pair of flanges 136 and 138 positioned on opposite edges. The flanges are provided with apertures 142 and 144, respectively.

A housing 148 is attached to the back edge of the bottom plate 128 and defines a compartment 150 within which a module, indicated at 152 in phantom, may be positioned. As an example, the module 152 may be a radio frequency identification tag which, as described previously, may be used as part of a miner tracking system. As with the first embodiment, alternative modules may be used including, but not limited to, an LED lighting module, a GPS navigation module, a natural gas detection module or a communication module.

While the adapter 126 may be constructed from a variety of materials and from one or more components, it preferably is molded in a single piece from polycarbonate plastic for durability, light weight and economy of manufacture. The module 152 of FIG. 8 may be secured within the compartment 150 with adhesive or the compartment may be sized so as to receive and hold the module in removable fashion in a socket arrangement. Alternatively, the module could be secured within the compartment using screws or other fasteners. Additional fastening and securing arrangements known in the art, both permanent and removable, could alternatively be used.

Figure 9:
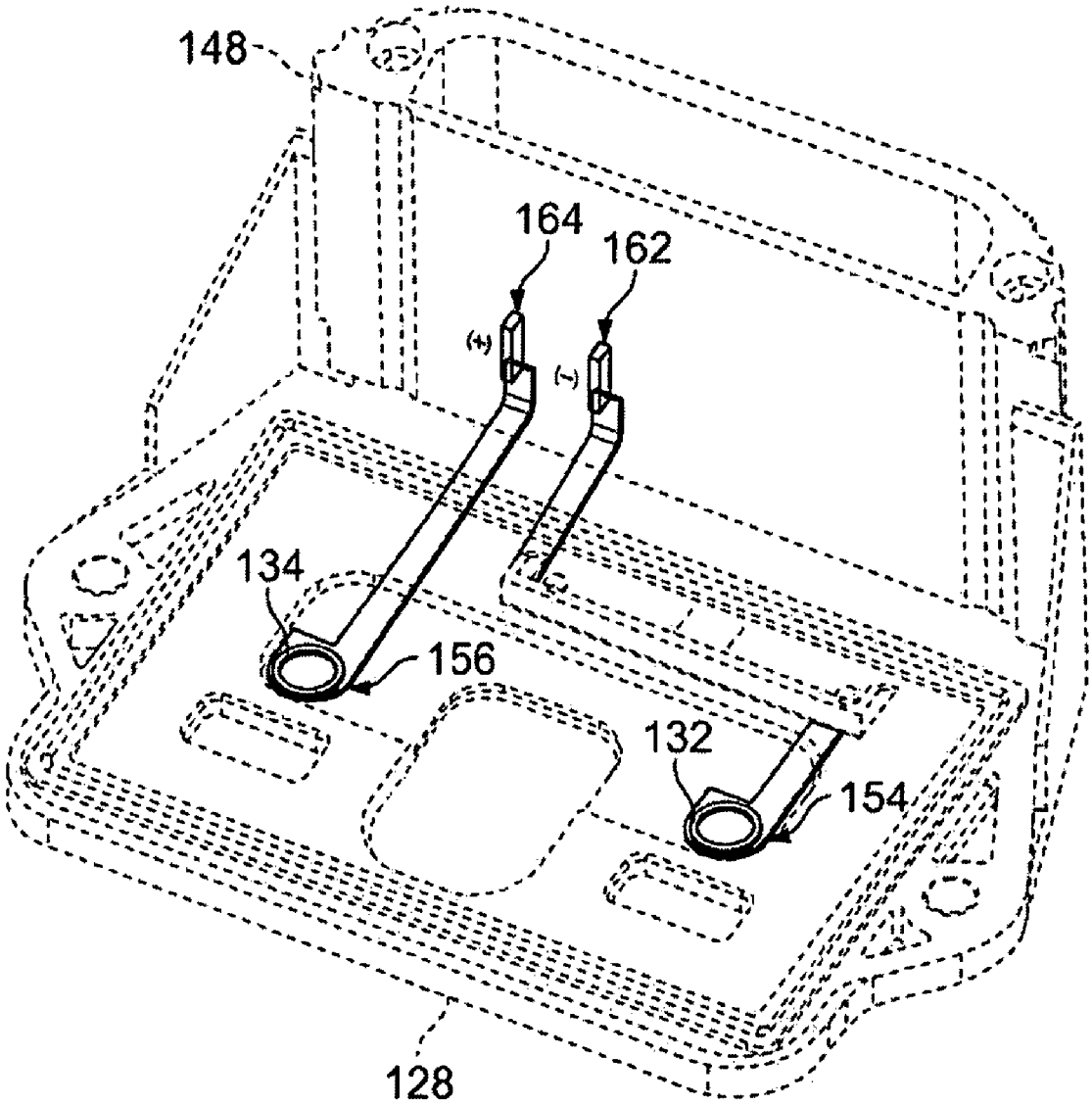
FIG. 9 is a perspective view showing the adapter of FIG. 8 in phantom so that the positive and negative contact leads may be viewed.

As illustrated in FIG. 9, the bottom plate 128 of the adapter also includes a positive contact lead 154 and a negative contact lead 156. These leads, which are preferably formed from strips of metal, run from the contact openings 132 and 134 to the housing and compartment contacts 162 and 164. The contact leads 154 and 156 may be molded into the bottom plate 128 and housing 148 or alternatively may be attached using adhesive or other methods known in the art.

Figure 10:
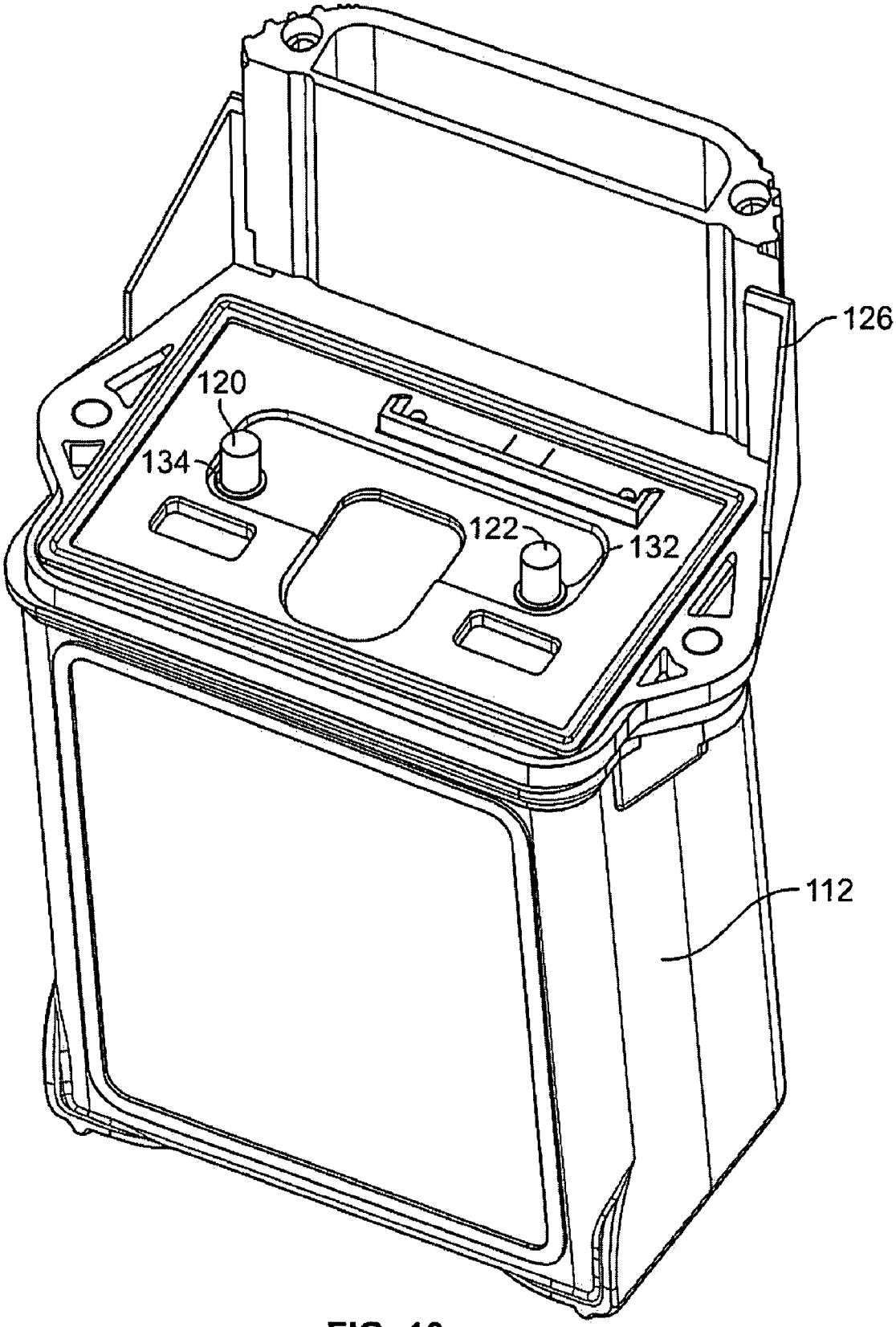
FIG. 10 shows the adapter of FIGS. 8 and 9 as it is being installed on the battery power pack of FIGS. 1 and 2 in accordance with the second embodiment of the invention.
Figure 11:
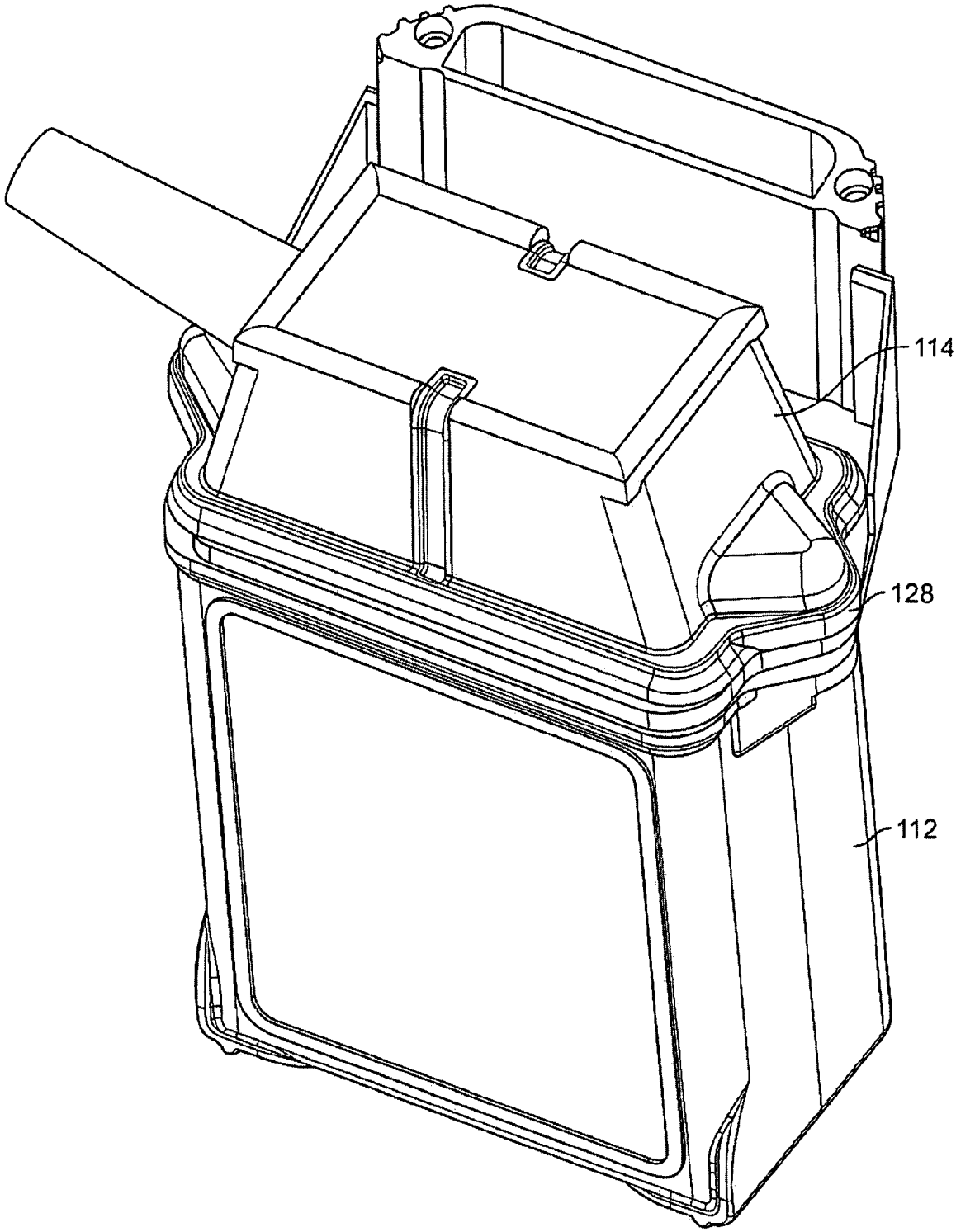
FIG. 11 shows the adapter of FIGS. 8, 9 and 10 fully installed on the battery pack of FIGS. 1 and 2 in accordance with the second embodiment of the invention.

The installation of the adapter 126 of FIGS. 8 and 9 upon the battery power pack 110 of FIGS. 6 and 7 is illustrated in FIGS. 10 and 11. Initially, the top cover (114 of FIG. 6) of the power pack is removed so that the power pack is in the configuration illustrated in FIG. 7. Next, the contact openings 132 and 134 (FIG. 8) of the adapter 126 are aligned with the positive and negative terminals 120 and 122 (FIG. 7) of the power pack. As illustrated in FIG. 10, the adapter 126 is then placed on top of the body 112 of the power pack so that the positive and negative terminals 120 and 122 of the power pack are received in, and make electrical contact with, the contact openings 134 and 132, respectively. In addition, the apertures of the power pack body flanges, 125 and 127 of FIG. 7, are aligned with the apertures of the adapter flanges, 142 and 144 of FIG. 8.

Finally, as illustrated in FIG. 11, the top cover 114 is positioned on top of the bottom plate 128 of the adapter so that the bottom plate 128 is sandwiched between the top cover 114 and the body 112 of the power pack. Screws are passed through the aligned apertures of the body and adapter flanges and into the flanges of the top cover so that the three components are secured together. As a result, the adapter is securely fastened to the battery power pack.

When the adapter 126 is attached to the power pack, as illustrated in FIG. 11, power from the battery within the power pack flows through the negative and positive contact leads 154 and 156 (FIG. 9) from contact openings 132 and 134 (FIG. 8) and terminals 120 and 122 (FIGS. 7 and 10) to the compartment contacts 162 and 164 (FIG. 9). The compartment contacts are in electrical communication with the contacts 172 and 174 (FIG. 8) of the module 152 so that the module 152 receives power from the battery.

In an alternative embodiment of the invention, the adapter may be provided with additional compartment contacts, and possibly more than one housing and/or compartment, so that more than one module may be supported by the adapter.

The foregoing description of the instant invention and the accompanying drawings is illustrative. Other modifications and variations can be made to the instant invention without diverging from the scope, spirit, or teaching of the invention.

What is claimed is:

1. A portable light source comprising:

a. a body of a power pack;

b. a battery located within said body;

c. a primary lamp in communication with the battery so as to receive power there from; and d. a module attached to said body so as to be positioned above the body of the power pack and also receiving power from said battery.

2. The portable light source of claim 1 wherein the primary lamp is a cap lamp in communication with the power pack via a power cord.

3. The portable light source of claim 2 wherein the module is a radio frequency identification module.

4. The portable light source of claim 1 wherein the battery is a lithium-ion battery.

5. Portable light source comprising:

a. a body;

b. a battery located within said body;

c. a primary lamp in communication with the battery so as to receive power there from;

d. a module;

e. an adapter wherein the module is attached to said body by the adapter and also receives power from said battery via the adapter; said adapter including a plate featuring positive and negative contact openings in electrical communication with positive and negative terminals of the battery, said adapter also including a housing defining a compartment with the module positioned therein, said compartment including compartment contacts in electrical communication with the positive and negative contact openings and said module so that said module receives power from the battery.

6. The portable light source of claim 5 wherein the module is removably mounted to the adapter.

7. The portable light source of claim 1 wherein the module is selected from the group consisting of a lighting module, a GPS navigation module, a tracking module, a natural gas detection module and a radio module.

8. An adapter for a holding and powering a module with a battery of a portable light source comprising:

a. positive and negative contact leads, each having a first end adapted to communicate with positive and negative terminals, respectively, of the battery;

b. a housing defining a compartment adapted to hold the module;

c. a bottom plate fixedly attached to said housing and featuring a positive contact opening and a negative contact opening adapted to removably engage a positive terminal and a negative terminal of the battery, respectively, said bottom plate also supporting said positive and negative contact leads with their first ends in communication with the positive and negative contact openings; and d. said positive and negative contact leads each also having a second end adapted to electrically communicate with a module positioned in the compartment so that power is provided thereto from the battery.

9. The adapter of claim 8 wherein the bottom plate and housing are molded from plastic.

10. The adapter of claim 9 wherein the bottom plate and housing are molded as a single piece.

11. The adapter of claim 8 wherein the positive and negative contact leads are strips of metal.

12. The adapter of claim 8 further comprising a flange with an aperture adapted to align with a flange and aperture of a body of the portable light source.

13. The adapter of claim 8 further comprising a module positioned in the compartment, wherein the module is selected from the group consisting of a lighting module, a GPS navigation module, a tracking module, a natural gas detection module and a radio module.

14. A cap lamp system comprising:

a. a cap lamp;

b. a power pack;

c. a battery positioned in the power pack and in electrical communication with the cap lamp; and d. an adapter including a plate featuring contact openings in electrical communication with the battery, said adapter adapted to hold and provide power to a module.

15. The cap lamp system of claim 14 wherein the battery is a lithium-ion battery.

16. The cap lamp system of claim 14 further comprising a module held by the adapter and receiving power from the battery via the adapter, wherein the module is selected from the group consisting of a lighting module, a GPS navigation module, a tracking module, a natural gas detection module and a radio module.

* * * * *